US006540396B1

(12) United States Patent
Barras

(10) Patent No.: US 6,540,396 B1
(45) Date of Patent: Apr. 1, 2003

(54) WATCH INCLUDING AN ADDITIONAL ELECTRIC APPARATUS

(75) Inventor: David Barras, Grenchen (CH)

(73) Assignee: Eta SA Fabriques d'Ebauches (CH)

( * ) Notice: Subject to any disclaimer, the term of this patent is extended or adjusted under 35 U.S.C. 154(b) by 0 days.

(21) Appl. No.: 09/599,539

(22) Filed: Jun. 23, 2000

(30) Foreign Application Priority Data

Jun. 23, 1999 (EP) ..... 99112103

(51) Int. Cl.[7] ..... G04B 37/00; G04B 23/02

(52) U.S. Cl. ..... 368/281; 368/282; 368/12; 368/315

(58) Field of Search ..... 368/10, 281, 282, 368/243, 72, 73, 245, 315, 11, 12; 340/407.1

(56) References Cited

U.S. PATENT DOCUMENTS

| | | | | |
|---|---|---|---|---|
| 4,697,931 A | | 10/1987 | Okuyama et al. | |
| 4,926,401 A | | 5/1990 | Vuilleumier et al. | |
| 5,181,192 A | * | 1/1993 | Paratte et al. | 368/282 |
| 5,471,438 A | * | 11/1995 | Kobayashi et al. | 368/281 |
| 5,481,506 A | * | 1/1996 | Kita | 368/10 |
| 5,663,703 A | * | 9/1997 | Pearlman et al. | 340/407.1 |
| 5,771,399 A | * | 6/1998 | Fishman | 368/47 |
| 5,838,639 A | | 11/1998 | Hwang | |
| 5,861,797 A | * | 1/1999 | Becker | 368/281 |
| 6,158,884 A | * | 12/2000 | Lebby et al. | 368/282 |

FOREIGN PATENT DOCUMENTS

| | | | | |
|---|---|---|---|---|
| CH | 640 688 | | 1/1984 | |
| CH | 672 870-G | A3 | 1/1990 | |
| EP | 0 349 230 | A2 | 1/1990 | |
| EP | 0 460 525 | A1 | 12/1991 | |
| GB | 2 159 304 | | 11/1985 | |
| GB | 2 226 661 | A | 7/1990 | |
| GB | 2 238 1460 | A | 5/1991 | |
| GB | 2254454 | A * | 10/1992 | 368/282 |
| WO | WO84/04406 | | 11/1984 | |
| WO | WO-96/34343 | A1 | 10/1996 | |
| WO | WO-97/19448 | A1 | 5/1997 | |
| WO | WO98/32057 | | 7/1998 | |

OTHER PUBLICATIONS

*Patent Abstracts of Japan*, vol. 002, No. 073 (E–78) '2693; Jun. 7, 1978 and JP 53 037068, Apr. 5, 1978, Fig. B.

* cited by examiner

*Primary Examiner*—Vit Miska
*Assistant Examiner*—Jeanne-Marguerite Goodwin
(74) *Attorney, Agent, or Firm*—Griffin & Szipl, P.C.

(57) ABSTRACT

The watch includes an electric battery housed in a removable drawer (6) engaged in the case (2), said drawer further including an additional electric apparatus powered by the battery. This apparatus may be a device operating in conjunction with the clockwork movement, for example an acoustic or tactile alarm member, or an independent device, for example a sensor or a data transmission device.

14 Claims, 2 Drawing Sheets

WATCH INCLUDING AN ADDITIONAL ELECTRIC APPARATUS

Figure 1:
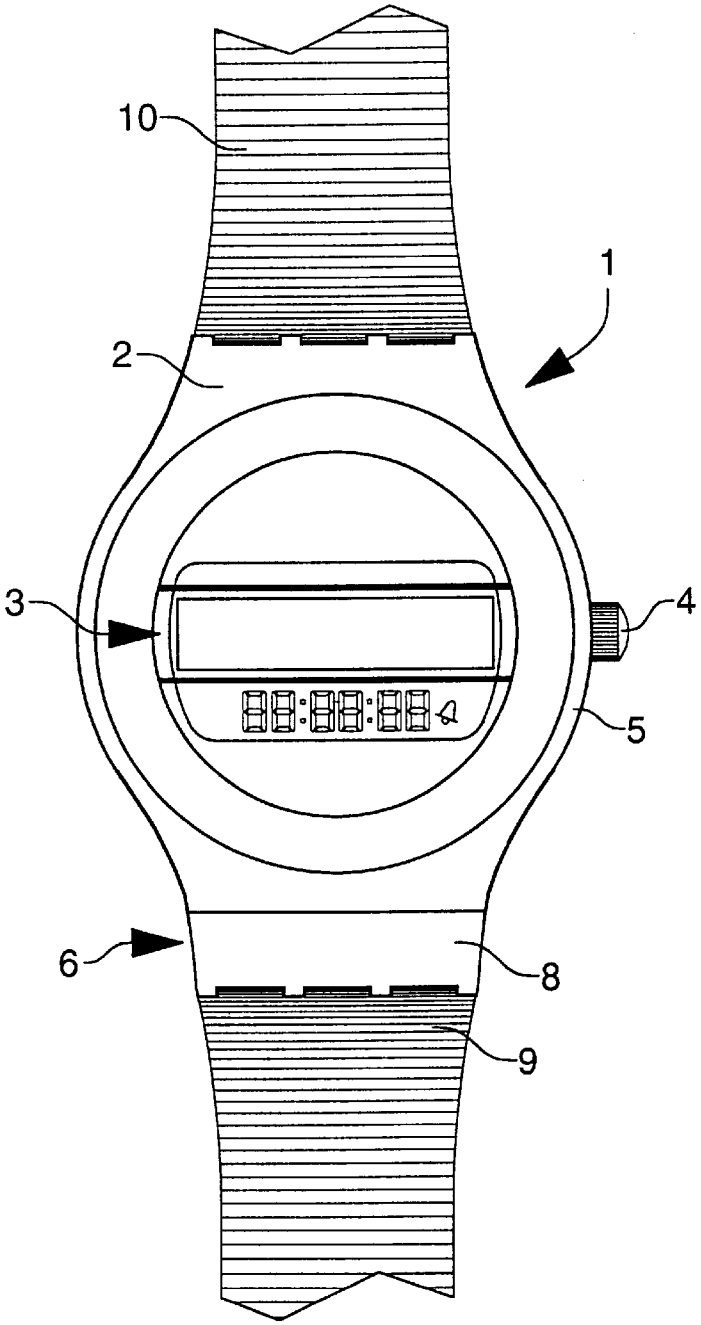

The present invention concerns a watch including a case, an electric clockwork movement housed in the case, provided with display means and powered by an electric battery; and an additional electric apparatus incorporated in a removable module and powered by said battery, the removable module being at least partially engaged in the case.

It is common to fit, in an electric watch, one or more electric devices powered by the same battery as the clockwork movement and offering additional functions, with or without a direct relationship with the clockwork movement. For example, watches combined with an additional apparatus such as a calculator, an electronic data base, a receiver for radio-diffused messages of the pager type (Swiss Patent No. CH 672 870), an acoustic or silent alarm (EP 0 349 230), a sensor for a physical parameter such as the temperature, pressure or the magnetic field, a lamp (GB 2 226 661, U.S. Pat. No. 5,838,639), an electronic camera, or a data transmission device, in particular via infrared beams (GB 2 238 146, WO 96/34343, WO 97/19448) are known.

International Patent Application No. WO 98/32057 describes a wristwatch including a main case, which contains an electronic watch complete with its battery, and a removable module laterally connected to the main case and capable of exchanging signals with the micro-controller of the watch. This module contains an additional apparatus provided with rechargeable batteries and communication means, for example an apparatus for measuring a television audience, for medical telemonitoring or for access control. The removable module is contained in a separate case which is laterally secured to the main case, the electric connections between the two cases being assured by plug-in connectors. When the two cases are thus assembled, the volume of the watch is substantially doubled and can be inconvenient.

International Patent Application No. WO 84/04406 describes an electronic watch having on the back thereof a housing intended to accommodate a removable auxiliary module which can exchange data with the internal circuits of the watch. No common electric power supply is provided in this case.

In Japanese Patent Application No. 53-37068 published on 5 Apr. 1978, an electronic watch of the type indicated in the preamble is disclosed. This watch is fitted with a removable module containing one or more additional modules such as a calculator, an alarm member, a memory or a signal receiver. This module can be replaced by another different module. It can be housed for example in a space reserved in the watch case. The additional apparatus is powered by the battery incorporated in the watch.

As such additional apparatus often consume more electric power than the clockwork movement, the battery has to be changed more often or a larger battery has to be used. For this purpose, European Patent No. EP 0 460 525, which corresponds to U.S. Pat. No. 5,181,192, provides a watch provided with a pager, incorporated in the case, and a drawer allowing a relatively large battery to be inserted through a lateral opening of low height arranged in the middle part of the watch. This construction is especially advantageous in the case of a pager watch because the back cover of the case can then be fixed and the battery hatch omitted, which means that the antenna turns can pass therethrough.

A basic idea of the present invention consists in using such a battery drawer to also house an additional apparatus consuming electric power, in particular an apparatus of the type described hereinbefore.

More particularly, the invention concerns a watch of the type indicated in the preamble, characterized in that the removable module is formed by a removable drawer engaged in the case and in that said battery is mounted in the drawer and is located inside the case when the drawer is engaged therein.

In addition to the intrinsic advantages of mounting the battery in a drawer, which greatly facilitates the replacement of the battery, this solution allows the additional apparatus, which can consume a relatively high current in certain cases, to be powered directly without the current necessarily passing through the internal watch circuits. Another significant advantage lies in the fact that the watch manufacturer can combine a basic watch case model with different drawers containing different additional apparatus. Likewise, since the drawer can be removed, the manufacturer can market a watch with several different interchangeable drawers which the user can choose to place in his watch.

Preferably, the drawer is engaged through a lateral opening in the case. The drawer can advantageously have an outer portion projecting into the exterior of the case, the apparatus extending at least partially into this outer portion. This allows an apparatus which could not normally find space entirely inside the case to be integrated in the watch, and the usual general shape and aesthetic appearance of the watch case to be kept.

Electronic control circuits for the additional apparatus can advantageously be arranged inside the case, outside the drawer, and be connected to the drawer by electric contact means.

Figure 2:
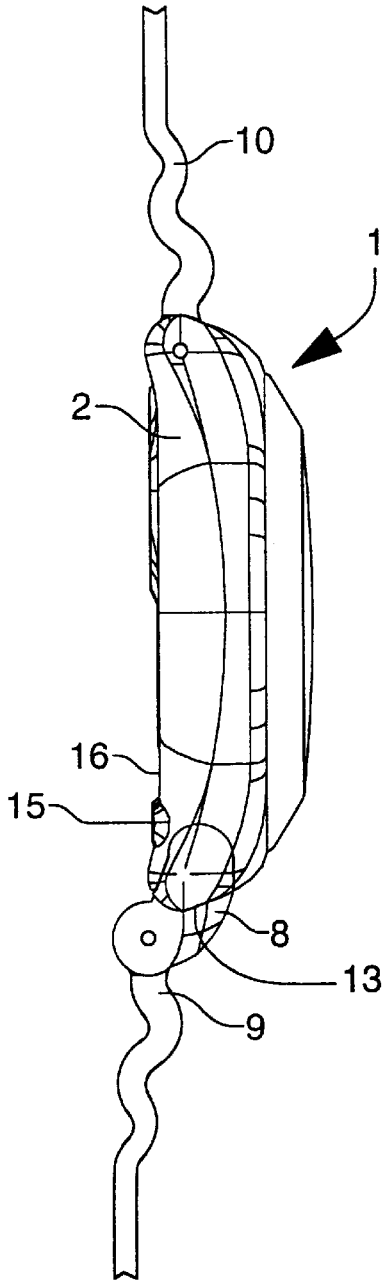
Figure 3:
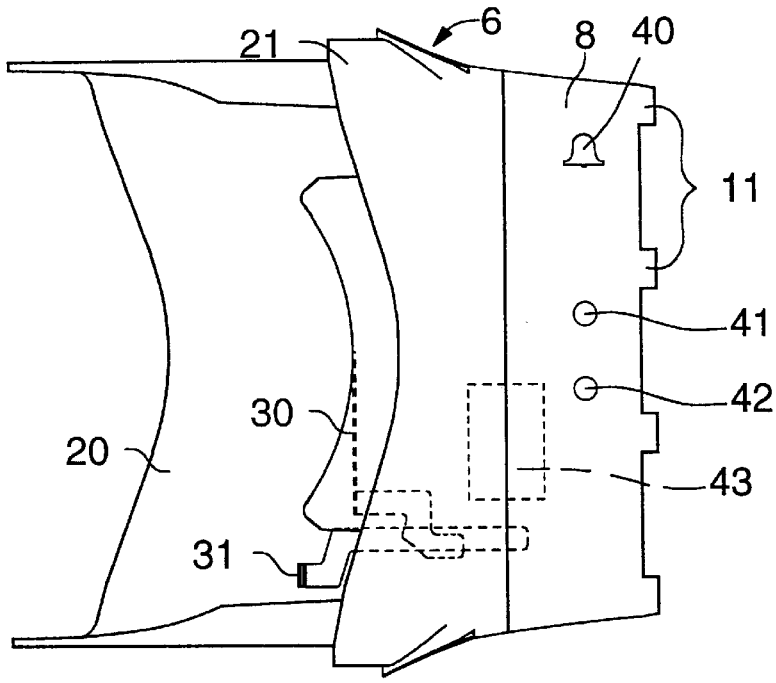
Figure 4:
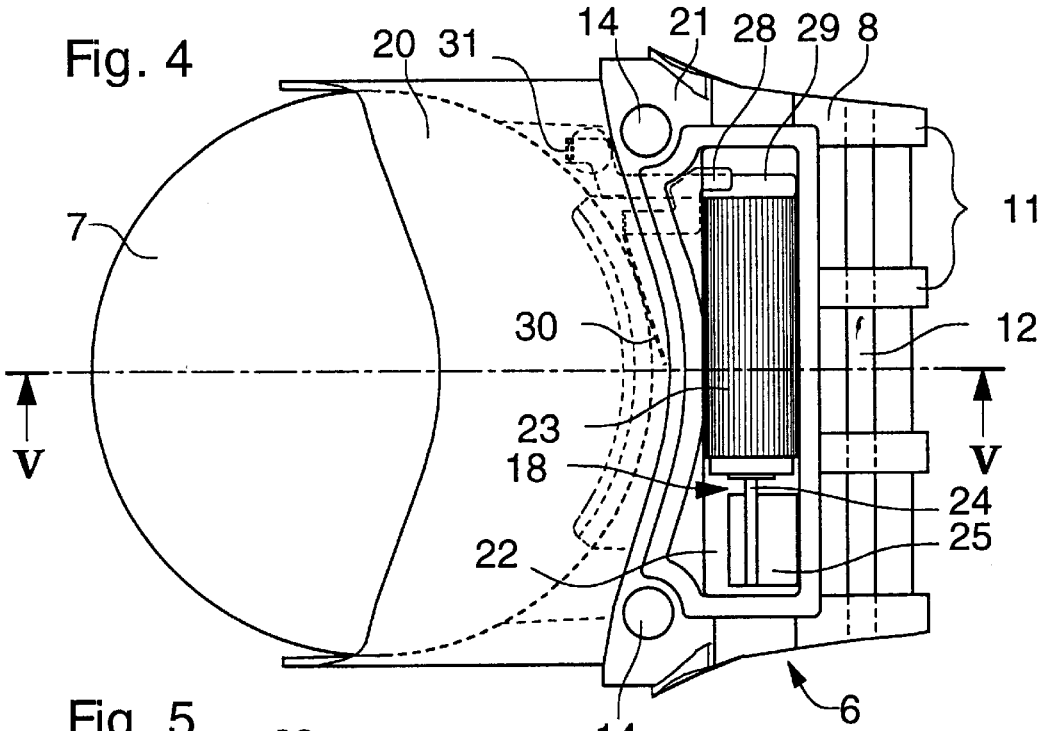
Figure 5:
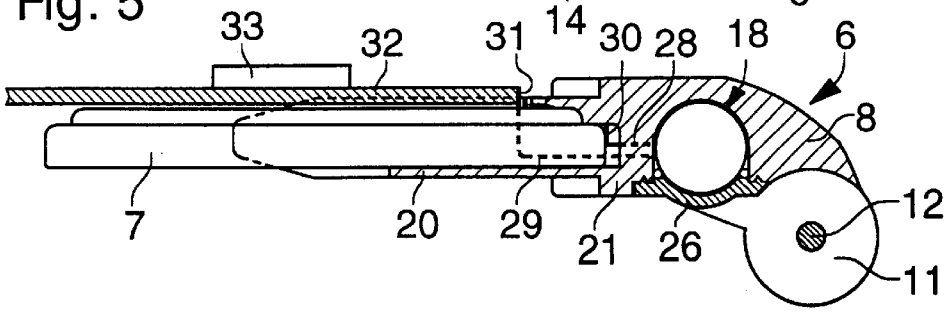

Other advantageous features of the invention will appear in the following description of a particular embodiment, given by way of non-limiting example with reference to the annexed drawings, in which:

FIG. 1 is a plane view of an electronic wristwatch fitted with a battery drawer containing a silent alarm member of the tactile type, FIG. 2 is a lateral elevation of the watch, FIG. 3 is an enlarged view of the top of the drawer, FIG. 4 is an enlarged view of the bottom of the drawer, and FIG. 5 is a cross-section along the line V—V of FIG. 4.

Watch 1 shown in the drawings includes a case 2 provided with display means 3 on its top face and a control crown 4 on one side of middle part 5 of the case. A removable drawer 6 accommodating an electric battery 7 is engaged by sliding into a lateral opening 13 of middle part 5 to a service position in which it extends partly inside case 2 and partly outside. In the present example, outer portion 8 of drawer 6 is located between middle part 5 and one end 9 of wristband 10, to which the drawer is fastened in a removable manner by projecting fastening members 11 and a metal bar 12, like a usual watch case and like the drawer described in European Patent No. EP 0 460 525, which corresponds to U.S. Pat. No. 5,181,192. Drawer 6 is held in the service position by one or more spring catches 14, each engaging in a hole 15 in back cover 16 of case 2. In order to remove the drawer, in particular to change the battery, the user presses on each of catches 14 to release it from hole 15 and he pulls the wristband or drawer himself Such a locking system is described in European Patent No. EP 0 460 525, which corresponds to U.S. Pat. No. 5,181,192, to which the reader may refer for more details.

The watch shown includes a silent alarm device, operating as an alarm clock and including a tactile alarm member 18 housed in drawer 6. Setting the current time and the alarm time, and setting the alarm mode are controlled in a conventional manner by means of control crown 4. Display means 3 are of the digital type here and allow the current time on the one hand and the alarm time and on/off state of the alarm on the other hand, to be indicated.

FIGS. 3 to 5 show more particularly the arrangement of drawer 6, which includes a portion 20 with a U-shaped transverse section, forming a receptacle for battery 7 and extending inside case 2 above the back cover thereof. A central portion 21 of the drawer is fitted into a corresponding lateral opening of middle part 5, where it cooperates-operates with a sealing gasket. This portion contains catches 14.

A housing 22 is arranged in outer portion 8 of the drawer for accommodating tactile alarm member 18, including an electric motor 23 whose shaft 24 carries a rotating member 25 having an unbalanced mass, i.e. the center of gravity of member 25 is off-center with respect to the rotational axis of shaft 24, in order to generate vibrations. A tactile alarm member of this type is marketed for example by LG Electro-components Ltd. under the reference GPV-041A. Housing 22 opens out onto the bottom face of drawer 6, where it is closed by a cover 26. In FIG. 4, this cover has been removed to clarify the drawing.

For the powering of motor 23, the two terminals of the motor are connected respectively to two connection strips 28 and 29 passing through central portion 21 of the drawer. Strip 28 includes a flexible horizontal portion 30 which is applied against the earth pole of battery 7. Strip 29 includes a flexible vertical portion 31 which is applied against a lateral contact provided on the edge of printed circuit board 32 of the watch. This board is powered by battery 7 as in the case of European Patent No. EP 0 460 525 and it carries, in addition to the electronic time-keeping circuits, electronic circuits 33 for controlling alarm member 18 via connection strip 29.

The tactile alarm signal generated by the rotation of member 25 causes not only drawer 6 to vibrate but also the whole of case 2, back cover 16 of which transmits the signal to the wearer. It is thus not necessary for drawer 6 to touch the wearer's skin.

Although drawer 6 described hereinbefore is attached to one end of wristband 10, this arrangement is not indispensable. For example, the opening in middle part 5 accommodating drawer 6 could be in a different location, in particular opposite control stem 4.

The applications of the present invention are not limited to a watch fitted with a silent alarm member, but extend to any other electric apparatus mounted in the drawer of the watch and powered by the battery housed in said drawer. In particular, the electric apparatus can consist of any of the additional electric devices mentioned in the introduction. FIG. 3 shows schematically and by way of example several variants including, respectively, a light indicator 40 on outer portion 8 of the drawer, optical communication means such as a transmitter 41 and a receiver 42 on said portion 8, or a pressure or other sensor 43 inside drawer 6. Further, the drawer may contain control circuits for the apparatus which it contains and include manual control means for the apparatus, for example touch buttons. This allows the drawer to be specifically arranged as a function of the apparatus which it contains and to be used in combination with a standard type of watch, while allowing the apparatus to be changed to the manufacturer or user's taste.

What is claimed is:

1. A watch including:

a case;

an electronic clockwork movement provided with display means and housed in the case; and a removable module formed by a removable drawer arranged to be at least partially engaged in the case, an electric battery being mounted in the drawer and located inside the case when the drawer is engaged therein;

wherein an electric alarm member is incorporated in the removable drawer and is controlled by the electronic clockwork movement; and wherein the electronic clockwork movement and the electric alarm member are powered by the electric battery mounted in the removable drawer.

2. A watch according to claim 1, wherein said drawer is engaged through a lateral opening in said case.

3. A watch according to claim 2, wherein said drawer has an outer portion projecting outside the case and wherein said electric alarm member extends at least partially into said outer portion.

4. A watch according to claim 3, said electric alarm member is a tactile alarm member, the watch being a wristwatch.

5. A watch according to claim 4, wherein said tactile alarm member includes an electric motor whose rotor is coupled to a rotating element with an unbalanced mass.

6. A watch according to claim 1, wherein said drawer has an outer portion projecting outside the case and wherein said electric alarm member extends at least partially into said outer portion.

7. A watch according to claim 6, including luminous indicating means on said outer portion of the drawer.

8. A watch according to claim 1, wherein said electric alarm member is a tactile alarm member, the watch being a wristwatch.

9. A watch according to claim 8, wherein said tactile alarm member includes an electric motor whose rotor is coupled to a rotating element with an unbalanced mass.

10. A watch according to claim 1, wherein said electric alarm member is an acoustic alarm member.

11. A watch including:

a case;

an electronic clockwork movement provided with display means and housed in the case; and a removable module formed by a removable drawer arranged to be at least partially engaged in the case, an electric battery being mounted in the drawer and located inside the case when the drawer is engaged therein;

wherein an electric alarm member is incorporated in the removable drawer and is controlled by the electronic clockwork movement; and wherein the drawer has an outer portion projecting outside the case and the electric alarm member extends at least partially into the outer portion.

12. A watch according to claim 11, wherein said electric alarm member is a tactile alarm member, the watch being a wristwatch.

13. A watch according to claim 12, wherein said tactile alarm member includes an electric motor whose rotor is coupled to a rotating element with an unbalanced mass.

14. A watch according to claim 11, wherein said electric alarm member is an acoustic alarm member.

* * * * *